US005385110A

United States Patent [19]

Bennett et al.

[11] Patent Number: 5,385,110

[45] Date of Patent: Jan. 31, 1995

[54] BOAT TRIM CONTROL AND MONITOR SYSTEM

[75] Inventors: Blake J. Bennett, Boca Raton, Fla.; David A. Hagstrom, Endicott, N.Y.

[73] Assignee: Bennett Marine, Incorporated of Deerfield Beach, Deerfield Beach, Fla.

[21] Appl. No.: 579,400

[22] Filed: Sep. 7, 1990

[51] Int. Cl.[6] ..... B63H 5/12

[52] U.S. Cl. ..... 114/285; 114/286

[58] Field of Search ..... 114/285, 286, 284, 287; 440/2; 340/689; 116/28 R, 67 R, 200; 73/1 E, 865.1, 304 C, 649, 724; 33/1 PT, 1 M, 1 N, 365, 366, 367, 377

[56] References Cited

U.S. PATENT DOCUMENTS

| | | | |
|---|---|---|---|
| 3,235,685 | 2/1966 | Litteral . | |
| 3,298,334 | 1/1967 | Holman . | |
| 3,334,608 | 8/1967 | Nemoto et al. | 33/377 |
| 3,404,651 | 10/1968 | Jensen et al. . | |
| 3,641,965 | 2/1972 | Schmiedel | 114/286 |
| 3,695,204 | 10/1972 | Bennett . | |
| 3,797,449 | 3/1974 | Carpenter et al. . | |
| 3,901,079 | 8/1975 | Vogel | 73/304 C |
| 3,911,592 | 10/1975 | Crask | 33/366 |
| 3,938,258 | 2/1976 | Zook | 33/366 |
| 4,261,278 | 4/1981 | Gaudin . | |
| 4,401,888 | 8/1983 | West et al. . | |
| 4,420,741 | 12/1983 | West | 114/285 |
| 4,567,666 | 2/1986 | Neis et al. | 73/1 E |
| 4,644,662 | 2/1987 | Anderson et al. . | |
| 4,644,893 | 2/1987 | Zepp | 114/286 |
| 4,652,878 | 3/1987 | Borgersen . | |
| 4,742,794 | 5/1988 | Hagstrom . | |
| 4,762,079 | 8/1988 | Takeuchi et al. . | |
| 4,797,661 | 1/1989 | Wiley . | |
| 4,800,542 | 1/1989 | Franklin et al. . | |
| 4,811,491 | 3/1989 | Phillips et al. . | |
| 4,861,291 | 8/1989 | Koike . | |
| 4,872,857 | 10/1989 | Newman et al. . | |
| 4,899,133 | 2/1990 | Bartlett . | |
| 4,908,766 | 3/1990 | Takeuchi . | |
| 4,987,776 | 1/1991 | Koon | 73/304 C |

FOREIGN PATENT DOCUMENTS

| | | | |
|---|---|---|---|
| 259385 | 8/1988 | Germany | 114/121 |
| 44396 | 2/1989 | Japan | 114/286 |

OTHER PUBLICATIONS

"Trim Control," Automatic Trim Control, Inc. (1978).
"Quentron Auto Tab," Quentron, Inc. (1981).

*Primary Examiner*—Jesus D. Sotelo
*Assistant Examiner*—Stephen P. Avila
*Attorney, Agent, or Firm*—Barnes, Kisselle, Raisch, Choate, Whittemore & Hulbert

[57] ABSTRACT

A boat trim control system that includes a boat having a bull and means such as trim tabs mounted to the hull for trimming attitude of the boat as the bull is propelled through the water. The system includes facility for selectively adjusting the trim tabs to maintain a desired boat attitude under varying load and sea conditions. A sensor is mounted on the boat hull to provide an electrical sensor signal as a function of boat attitude, and is connected to electronic control circuitry responsive to the sensor signal for determining attitude of the boat bull. This electronic control circuitry further includes facility for operator setting of a desired boat attitude. The electronic control circuitry is coupled to an operator display for indicating departure of actual boat attitude indicated by the sensor from the boat attitude desired by the operator, and/or to automatic control circuitry for automatically varying trim tab orientation with respect to the boat bull so as to maintain the boat attitude desired by the operator.

53 Claims, 9 Drawing Sheets

Microfiche Appendix Included
(49 Microfiche, 1 Pages)

BOAT TRIM CONTROL AND MONITOR SYSTEM

Reference is made to a microfiche appendix that forms part of this application, consisting of one sheet of fiche containing forty-nine frames.

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

The present invention is directed to trim control of power boats, and more particularly to a system for automatically and continuously sensing boat attitude, displaying boat attitude to an operator and/or correcting boat attitude to a desired orientation.

BACKGROUND AND OBJECTS OF THE INVENTION

U.S. Pat. No. 3,695,204 discloses an electrohydraulic system for manually controlling trim tabs on power boats to maintain a boat attitude desired by an operator as the boat is propelled through the water. The system includes a pump and a pair of directional valves coupled to a manual switch for selectively feeding hydraulic fluid to actuators coupled to the trim tabs. The trim tabs are thereby independently adjustable under continuous and direct manual control of the operator.

U.S. Pat. No. 4,742,794 discloses apparatus for use in connection with trim tab control systems of the aforementioned type for displaying trim tab position to the operator. A sensor mounted within each hydraulic actuator provides a signal indicative of actuator extension, and therefore indicative of angular orientation of the trim tab with respect to the boat hull. The sensors are coupled to associated oscillators for varying output frequency thereof as a function of trim tab orientation. The outputs are coupled to respective counters, which in turn are coupled to suitable displays, such as bar-type displays, for indicating trim tab orientation to the boat operator.

Although trim control and display systems disclosed in the noted patents, both assigned to the assignee hereof, have enjoyed substantial commercial acceptance and success, improvements remain desirable. For example, there is a need in the market for an economical and reliable system that continuously senses actual attitude of the boat hull—e.g., fore/aft attitude about an axis lateral to the hull and port/starboard attitude about an axis longitudinal to the hull—and automatically controls trim tab orientation so as to maintain a boat attitude desired by the operator. There is also a need in the market for a system adapted automatically and continuously to sense and display boat attitude to an operator, either in combination with automatic trim tab control capability as previously described, in conjunction with manual control capability through which the operator may selectively vary trim tab orientation so as to correct undesired changes in boat attitude as shown on the display, or for display purposes in sailboats, for example, with no trim control capability. It is therefore a general object of the present invention to provide a boat trim control system that includes facility for sensing boat attitude as the boat is propelled through the water, automatically controlling boat trim so as to maintain a desired attitude, and/or displaying boat attitude to an operator for correction as desired.

Another and more specific object of the present invention is to provide a system of the described character that includes a boat attitude display that can be readily understood by a boat operator with little or no training. Yet another object of the invention is to provide a sensor for determining orientation of a structure on which the sensor is mounted, such as a boat bull, about two orthogonal axes independently of each other, which is economical to manufacture and may readily be assembled to the boat hull or other support structure by untrained personnel with a minimum of direction, for which mounting orientation is not critical, and which is particularly well adapted for use in conjunction with microprocessor-based trim display and/or control electronics.

SUMMARY OF THE INVENTION

A boat trim control system in accordance with the present invention includes a boat having a hull. A sensor is mounted on the boat hull to provide an electrical sensor signal as a function of boat attitude, and is connected to electronic control circuitry responsive to the sensor signal for determining attitude of the boat hull. This electronic control circuitry further includes facility for operator setting of a desired boat attitude. The electronic control circuitry is coupled to an operator display for indicating departure of actual boat attitude indicated by the sensor from the boat attitude desired by the operator. The system may include means such as trim tabs for trimming boat attitude under varying load and sea conditions, and automatic control circuitry for automatically varying trim tab orientation with respect to the boat bull so as to maintain the boat attitude desired by the operator.

In accordance with one important aspect of the present invention, the boat attitude display comprises an operator console in which a boat icon is displayed on a screen and is oriented with respect to other display indicia on the screen as a function of actual boat attitude for indicating such actual boat attitude to the operator. Preferably, the display console operator panel includes a push button coupled to the control circuitry for storing output signals from the sensor, associated with actual boat attitude, when the push button is depressed. Further, at this point, the boat icon on the display screen is automatically oriented at a zero or home orientation. Thereafter, icon orientation on the display screen is varied as a function of departure of the boat attitude sensor signals from the signals stored by the operator. In one of two (or more) display modes alternatively selectable by the operator, the boat icon is a schematic diagram of a boat hull in plan view, which is oriented with respect to cross hairs on the screen as a function of actual boat attitude. When the operator push button is initially depressed and boat attitude desired by the operator is stored, the icon is initially centered in the cross hairs. Thereafter, the boat icon is moved from this centered position by a distance and in a direction corresponding to change in boat attitude from the attitude desired by the operator. In the other display mode of operation, two boat icons are displayed on the screen in schematic side and end elevation. Angle of the icons from the initial display orientation varies with boat attitude. Preferably, alphanumeric indicia is also display in one or both of the display modes of operation for indicating magnitude of departure from desired orientation.

In accordance with another aspect of the present invention, the boat attitude sensor comprises a plurality of capacitance probes contained within a housing and immersed in dielectric fluid. Each of the probes comprises a pair of electrodes immersed in the fluid such that the level of fluid between the electrodes, and therefore electrical capacitance between the electrodes, varies by force of gravity as a function of attitude of the housing and the boat hull or other support structure to which the housing is mounted. Electrical circuitry is coupled to the electrodes, and is responsive to variations in electrical capacitance therebetween, for determining attitude of the housing as a function of relative capacitance among the electrodes. In the preferred embodiment of the invention, four capacitance probes are positioned within the housing in an orthogonally space planar array. Each probe is electrically connected to an oscillator, such that the output frequency of each oscillator varies as a function of capacitance at the associated probe, and therefore as a function of liquid level between the associated probe electrode pair. Attitude about each of the two orthogonal axes is determined as a function of a difference in frequency between the probes spaced from each other in the direction of that axis. Since the circuitry is responsive to a difference in frequencies rather than the absolute value of either frequency, orientation of the sensor within the boat hull is much less critical than with sensors heretofore proposed.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
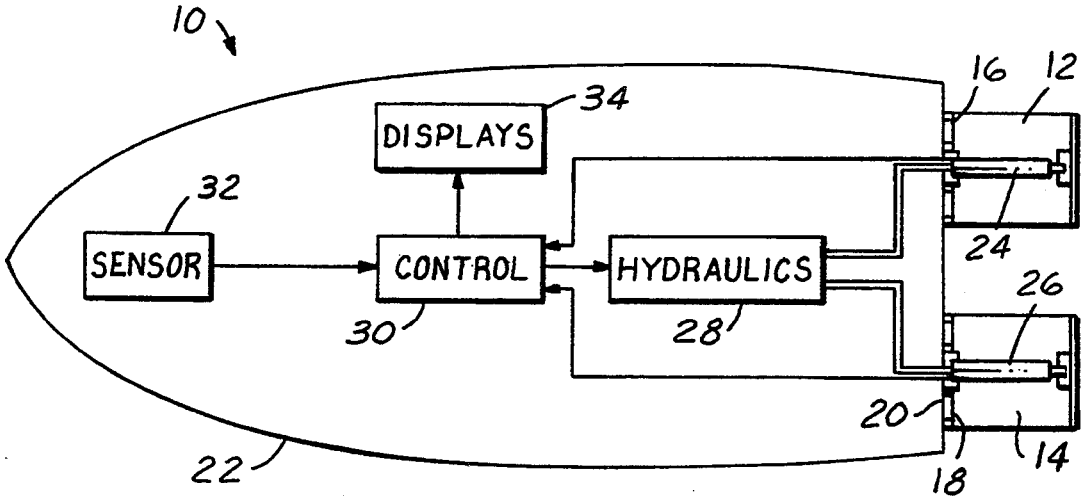
FIG. 1 is a schematic diagram of a boat equipped with a trim control system in accordance with a presently preferred embodiment of the invention.

FIG. 1 illustrates a power boat trim control system 10 in accordance with a presently preferred embodiment of the invention as comprising a pair of trim tabs 12,14 pivotally mounted by respective hinges 16,18 on the stern 20 of a boat hull 22. A pair of hydraulic actuators 24,26 are respectively mounted on stern 20 and have actuator rods that extend to trim tabs 12,14. (Actuators 24,26 may also be electric or pneumatic.) Actuators 24,26 are driven by a hydraulic system 28 under electronic control 30. Electronic control 30 receives an input from a sensor 32 indicative of actual boat attitude, and inputs from actuators 24,26 indicative of extension of the respective actuators, and thus indicative of actual position of trim tabs 12,14. Controller 30 also drives displays 34 for providing status and control information to a boat operator.

Figure 2:
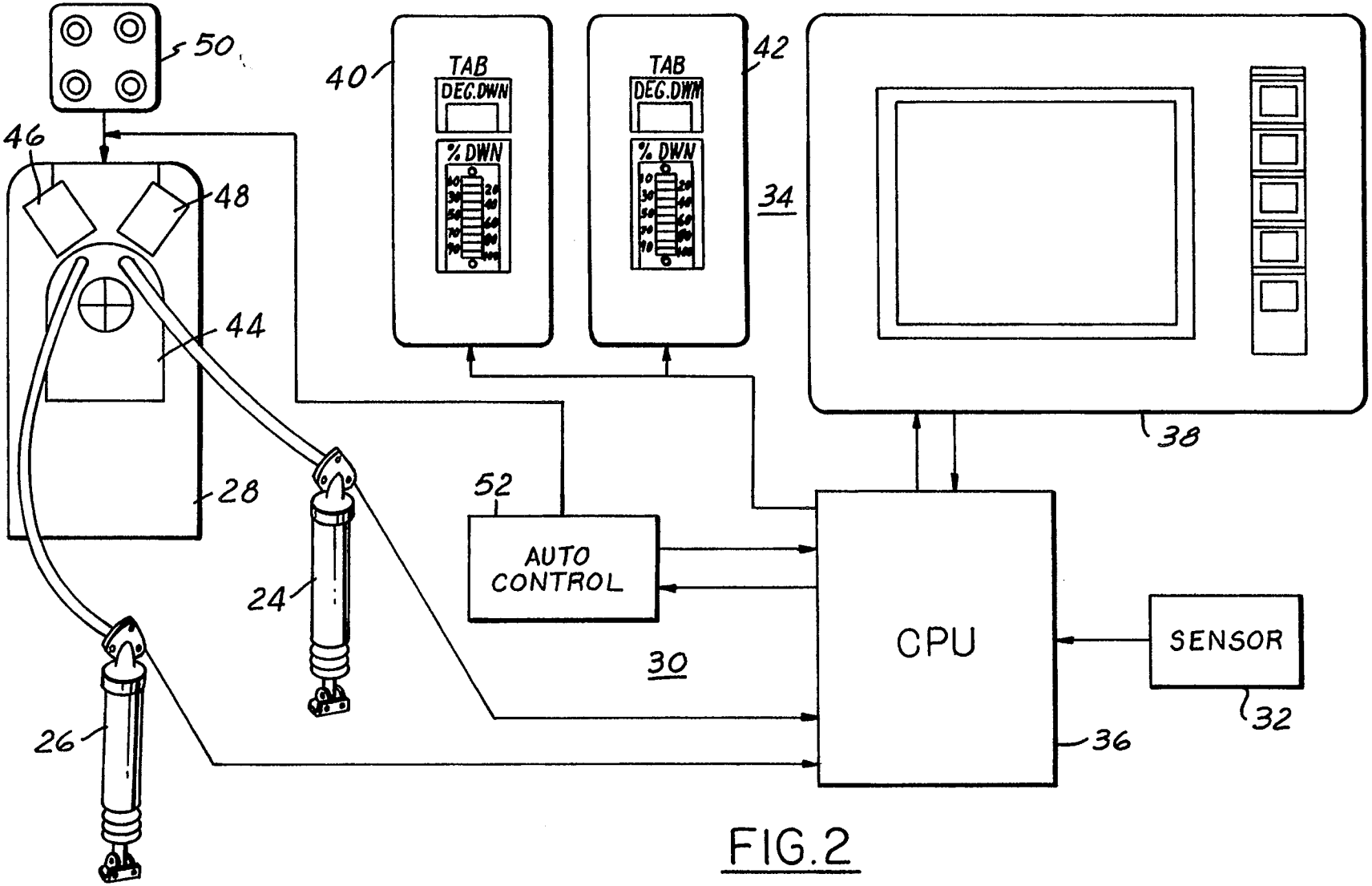
FIG. 2 is a functional block diagram of the trim control system illustrated in FIG. 1.

FIG. 2 is a functional block diagram of control system 10. Sensor 32 (FIGS. 2–4) provides electrical signals indicative of actual boat attitude to a central processing unit or CPU 36 (FIGS. 2 and 5). Displays 34 include a boat attitude or position indicator 38 (FIGS. 2 and 6–9) that receives information from CPU 36 for displaying actual boat attitude to an operator, and transmits information to CPU 36 indicative of boat attitude desired by the operator. CPU 36 also receives signals from the position sensors within actuators 24,26, and provides corresponding trim tab position display information at respective display panels 40,42. Operation of the trim tab sensor and display feature of the invention is the same as that disclosed in detail in U.S. Pat. No. 4,742,794, to which reference is made for more detailed discussion need not be discussed further. Hydraulics package 28 includes a pump 44 and a pair of valves 46,48 electrically coupled to and responsive to a four-button switch 50 (or other suitable switch) through which an operator may manually raise and lower the respective trim tabs. Operation of actuators 24,26 by pump 44, valves 46,48 and switch 50 is as disclosed in U.S. Pat. No, 3,695,204, to which reference is made for more detailed discussion. Pump 44 and valves 46,48 are also coupled to an automatic control circuit 52, which in turn is coupled to CPU 36, for automatically controlling trim tab position, as a function of actual and desired boat attitudes, independently of four-button switch 50.

Figure 3:
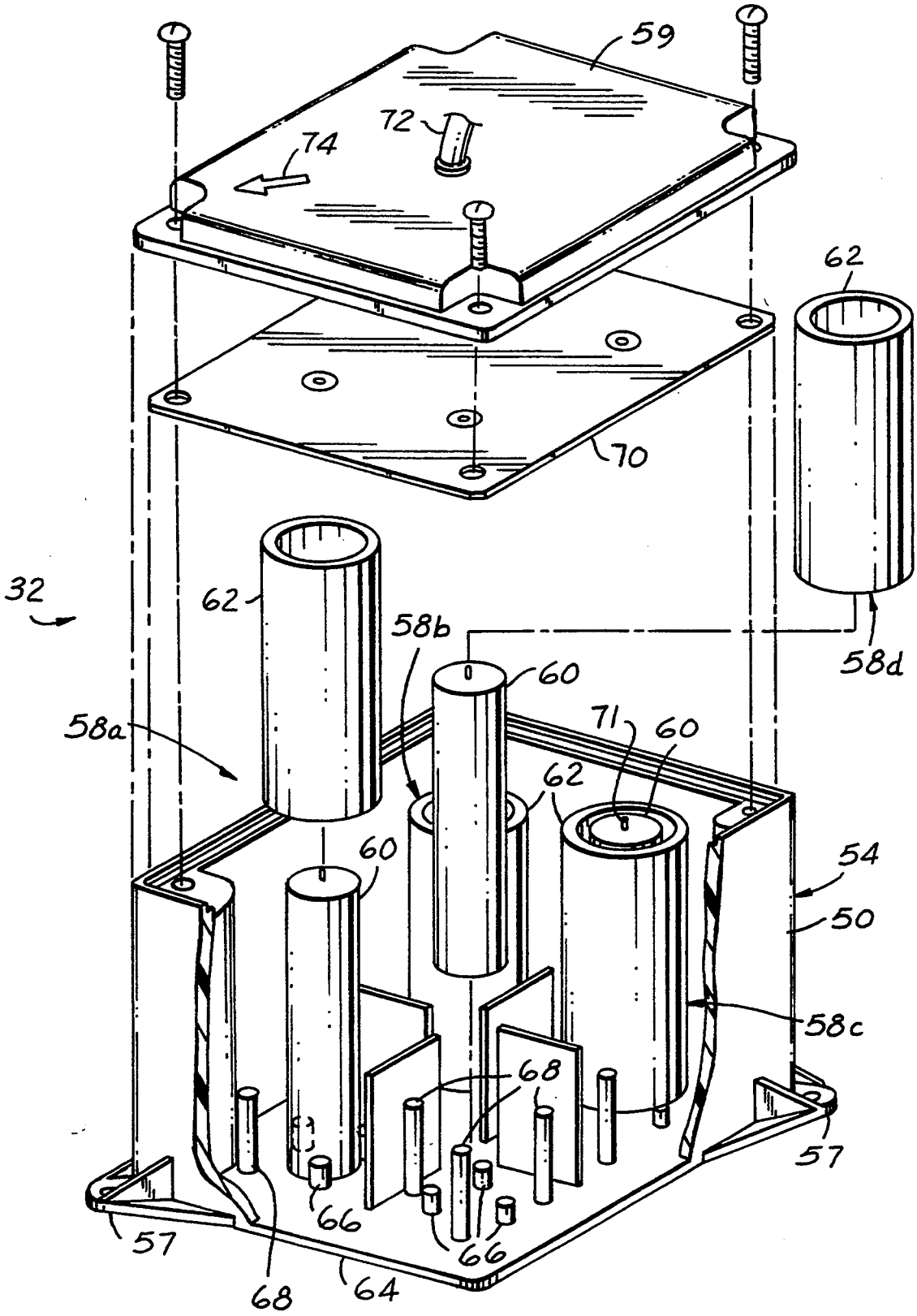
FIG. 3 is an exploded perspective view of the boat attitude sensor illustrated in FIGS. 1 and 2.
Figure 4:
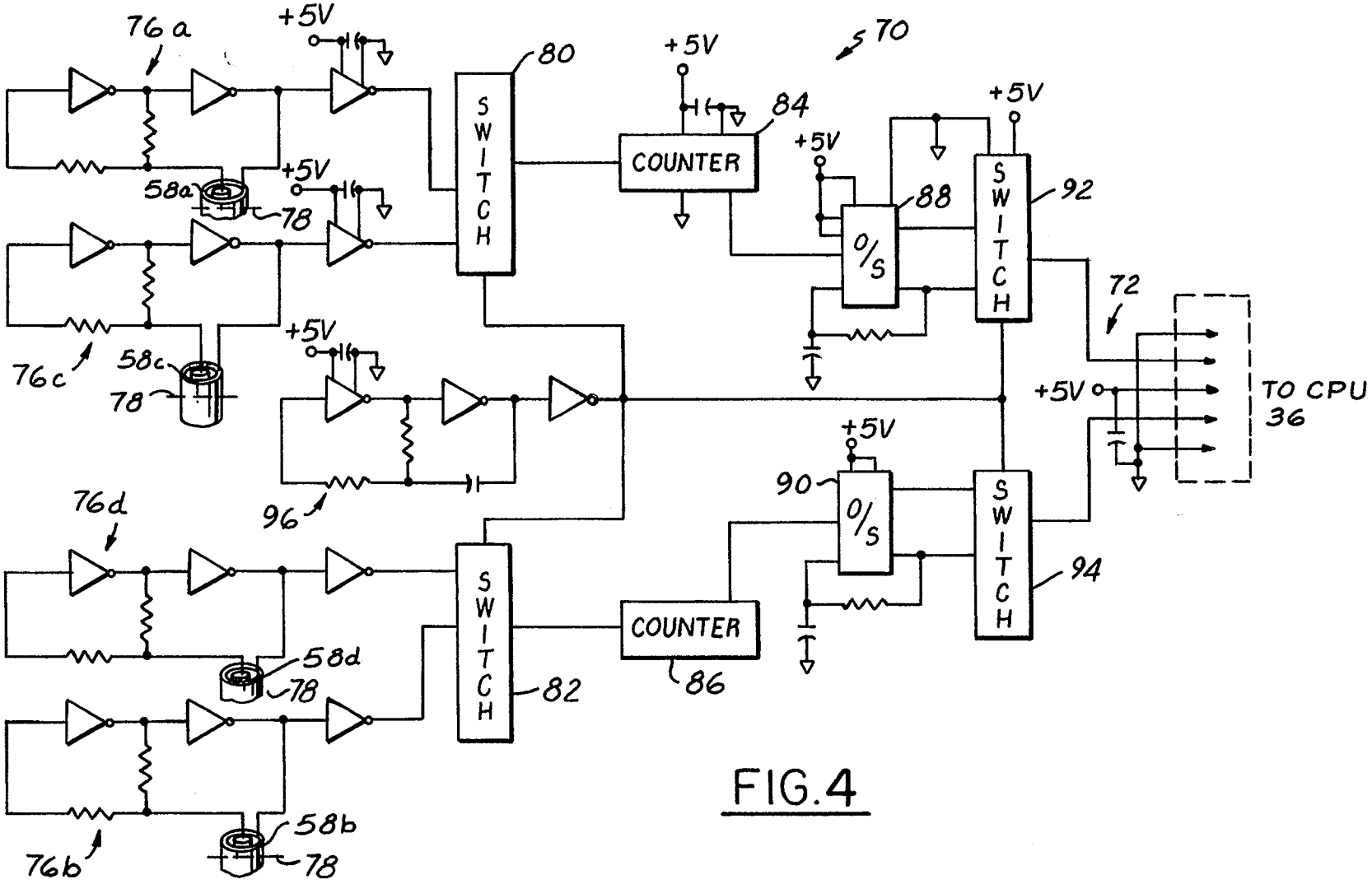
FIG. 4 is an electrical schematic diagram of the boat attitude sensor illustrated in FIGS. 1–3.
Figure 5:
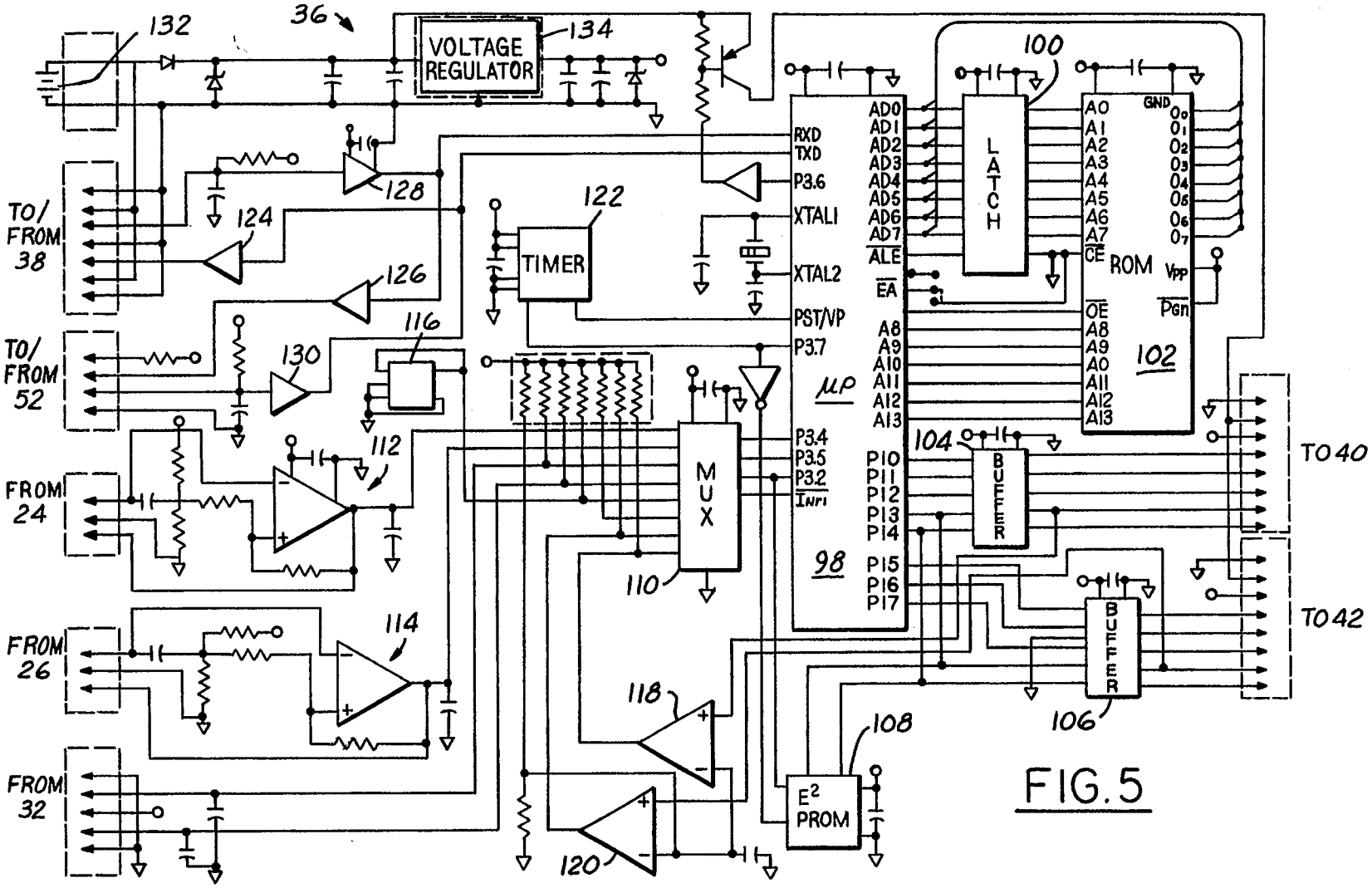
FIG. 5 is an electrical schematic diagram of the central processing unit illustrated in FIG. 2.

Boat attitude sensor 32 is illustrated in greater detail in FIGS. 3–4. Sensor 32 comprises a housing 54 having a generally rectangular base 56 and a cover 60. Within base 56, adjacent to the respective corners thereof, are four capacitance probes **58*a*,58*b*,58*c*,58*d*, each comprising a cylindrical inner electrode 60 surrounded by a cylindrical outer electrode 62. The probes 58*a*–58*d* are held in a diagonally spaced planar array within base 56 by buttons upstanding from the bottom wall 64 of base 56. In particular, the lower end of each inner electrode 60—i.e., the end adjacent to bottom wall 64—is captured against lateral motion by three angularly spaced buttons 66. Likewise, the lower end of each outer electrode 62 is outwardly captured against lateral motion by three angularly spaced buttons 68. The upper ends of the electrodes 60,62 are in electrical and mechanical abutting engagement with suitable conductors on the lower face of an electrical printed circuitboard assembly 70, which in turn is mounted on shoulders at the corners of the housing base. Pins 71 extend through circuitboard 70 into apertures in the opposing upper face of electrodes 60 for enhanced electrical contact and mechanical capture. The upper and lower ends of the inner and outer electrodes 60,62** are thus firmly captured against lateral motion so as to maintain uniform spacing between the inner and outer electrodes, and among the electrode pairs.

Housing base 56 is partially filled with dielectric fluid 78 (FIG. 4) such as synthetic motor oil, so that the electrodes 60,62 of the probes are partially immersed therein. Cover 59 is affixed to base 56, and an electrical cable 72 connects circuitboard assembly 70 to CPU 36 (FIG. 2). Flanges or tabs 57 extend outwardly from diagonally opposed corners of base 56 in the plane of bottom wall 64 for affixing sensor 32 to suitable support structure, such as a boat hull. An arrow 74 or other suitable indicia on cover 59 indicates the corner of housing 54 to be oriented toward the bow of the boat, although precision of such orientation is not critical, as previously noted.

The circuitry of circuitboard assembly 70 is illustrated schematically in FIG. 4. Each probe 58*a*–58*d* is electrically connected within an associated oscillator 76*a*–76*d*. Thus, the output frequencies of the respective oscillators vary as a function of capacitance at the associated probes, which in turn vary as a function of level of dielectric fluid 78 between the electrodes of each probe. The output of front oscillator 76*a* and the output of aft oscillator 76*c* are connected to associated inputs of an electronic switch 80. Likewise, the output of port oscillator 76*d* and starboard oscillator 76*b* are connected to corresponding inputs of an electronic switch 82. (Directional adjectives such as "port" and "starboard" are employed for purposes of description only.) The outputs of switches 80,82 are fed to the count inputs of associated counters 84,86. The outputs of the respective counters are fed to the trigger inputs of corresponding one-shots 88,90, the high and low outputs of which are fed to the corresponding inputs of respective electronic switches 92,94. The outputs of switches 92,94 are connected by cable 72 to CPU 36 (FIGS. 2 and 5). The control inputs of switches 80,82,92,94 are all connected to an oscillator 96.

In operation of sensor electronics 70 illustrated in FIG. 4, the frequencies of the inputs to switches 80,82 vary as a function of capacitance at the associated probes, as previously noted. Thus, the frequencies at the inputs to switch 80 vary as a function of capacitance at the bow and stern probes 58*a*,58*c* (with respect to the direction of arrow 74 in FIG. 3), so that the difference between such frequencies is a direct indication of bow/stern pitch of the boat. Likewise, the difference between the frequencies at the inputs to switch 82 from port and starboard oscillators 76*d*,76*b* is a direct indication of starboard/port roll about the longitudinal axis of the boat. Switch 80 selectively feeds to counter 84 either the bow or stern oscillator output signal, under control of oscillator 96. Likewise, switch 82 selectively feeds to counter 86 either the port or starboard oscillator output signal, under control of oscillator 96. One-shots 88,90 are triggered by counters 84,86. Switches 92,94 are controlled by oscillator 96 in correspondence with switches 80,82.

Thus, signals indicative of pitch and roll of the boat are fed to CPU 36 by switches 92,94 and cable 72. Since such pitch and roll signals are determined by frequency differences at the associated oscillator pairs, rather than by absolute value of any frequency, the sensor and associated electronics are not only independent of temperature and temperature variations at the dielectric fluid (which will affect all probes simultaneously), but also less critically related to orientation of the sensor. That is, for example, the difference in frequencies at bow oscillator 76*a* and stern oscillator 76*c* will indicate bow/stern boat pitch even if the respective probes 58*a*,58*c* are not precisely positioned on the longitudinal axis of the boat. Sensitivity will vary as the bow/stern probes depart from positioning on the longitudinal axis, but the frequency difference will still function to indicate boat pitch. CPU 36 readily accommodates such variations in sensitivity.

FIG. 5 is an electrical schematic diagram of CPU 36. A microprocessor 98 is connected by a latch 100 to a read-only-memory or ROM 102 that contains programming for control of microprocessor 98 to function as described. Output ports of microprocessor 98 are connected to trim tab displays 40,42 (FIG. 2) through a pair of buffers 104,106 and appropriate cabling. An EEPROM 108 stores information for calibration of trim tab displays 40,42. A multiplexer 110 receives signals from an oscillator 112 coupled to the position sensor at actuator 24, from an oscillator 114 coupled to the position sensor at actuator 26, from sensor 32 indicative of pitch and roll at the sensor, from an operator switch 116 suitably positioned for enabling the operator to recalibrate trim tab displays 40,42 as desired, and from trim tab display error checking comparators 118,120. The signal selection control inputs of multiplexer 110 are connected to corresponding ports on microprocessor 98, as are the serial data outputs. A watchdog timer 122 monitors continuing operation of microprocessor 98, and resets the microprocessor in the event of malfunction. The serial data transmission port of microprocessor 98 is connected through an amplifier 124 and suitable cabling to boat attitude display 38. The serial data reception port of microprocessor 98 is connected by an amplifier 128 and suitable cabling to receive data from display 38. Amplifiers 126,130 provide serial I/O at an auxiliary port. Power is supplied by a boat battery 132 and a voltage regulator 134.

In operation, CPU 36 provides the central intelligence for the other various electronic modules. The position signals from actuator 24,26 vary frequency of oscillators 112,114, and corresponding trim tab position display information is stored and transmitted at buffers 104,106. Likewise, pitch and roll signals indicative of actual boat attitude are received from sensor 32. This information is converted to serial data as required, and transmitted to display 38. Microprocessor 98 receives and stores the desired boat attitude selected by the operator at display console 38. Likewise, control information is fed to auto control circuit 52, and status information is received therefrom.

Figure 6:
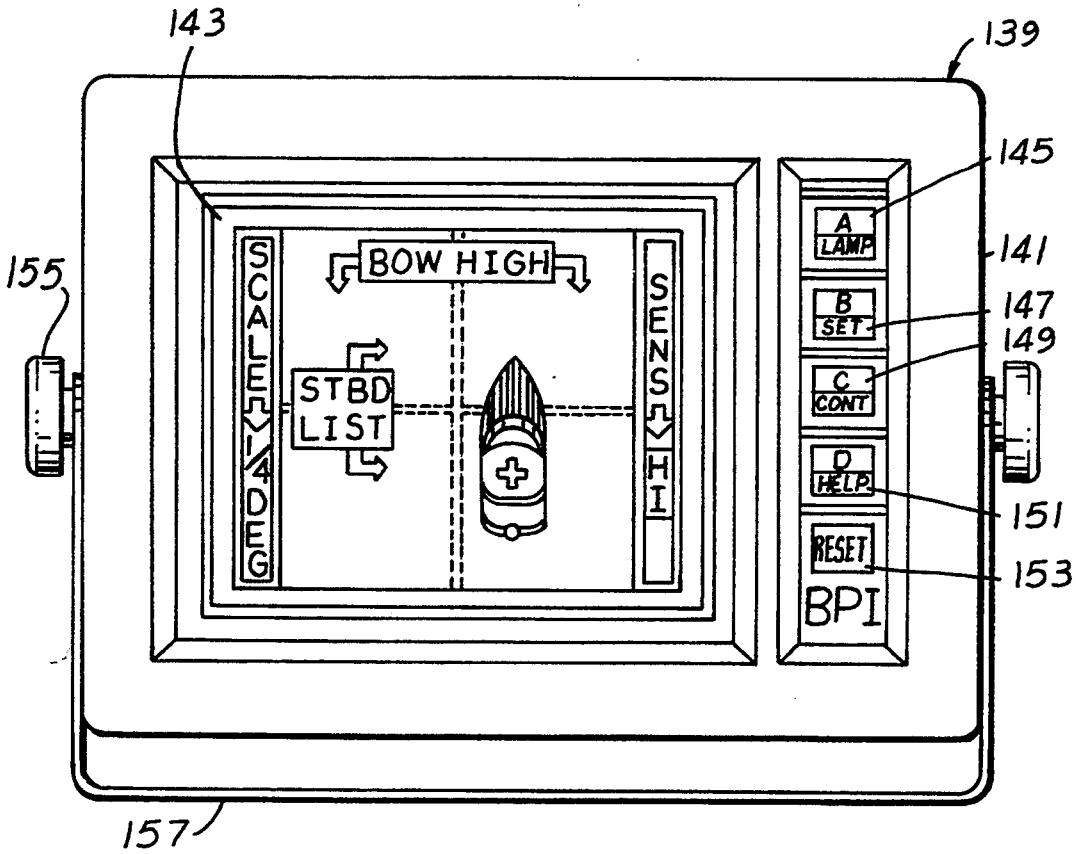
FIG. 6 is a front elevational view of the boat position or attitude indicator console in accordance with a presently preferred embodiment of the invention.

FIG. 6 illustrates boat attitude display console 38 as including a front or operator panel 141 having a display screen 143 and a vertical array of push button control switches 145,147,149,151,153 along one side of screen 143. Button 145, upon depression, illuminates the back lighting on screen 143. Button 141, upon depression, sets or "zeros" the display to the actual current boat orientation. Button 149 incrementally adjusts contrast at screen 143, and button 50 calls up the "help" menu to assist the operator. Button 52, upon depression, selects among various operator menu screens. Console 38 is carried by a bracket 157, by means of which the console may be mounted at any desired location on the boat, and is adjustable thereon by means of knobs 155. Console 38 may also be flush mounted in a dashboard.

Figure 7:
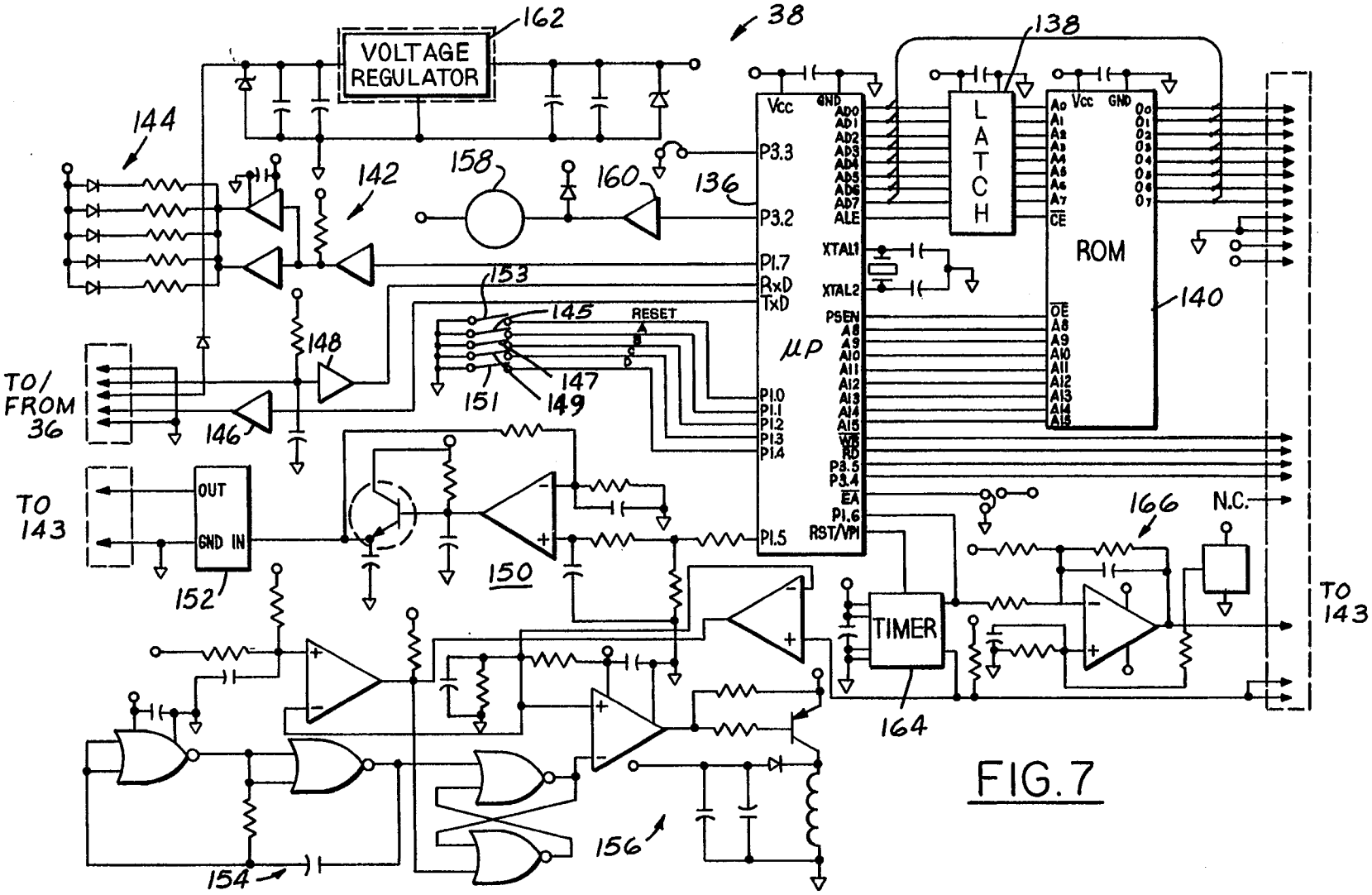
FIG. 7 is an electrical schematic diagram of the boat position indicator illustrated in FIG. 6.

FIG. 7 is an electrical schematic diagram of console 38. A microprocessor 136 is connected by a latch 138 to a ROM 140, which contains control programming for operation of console 38 as will be described. Panel push button switches 145,147,149,151,153 are connected to associated ports of microprocessor 136. Microprocessor 136 is also connected through a series of amplifiers 142 to LED's 144 for illuminating the buttons of the operator panel switches. The transmit and receive ports of microprocessor 136 are connected to the complimentary ports of CPU 36 through associated amplifiers 146,148. Microprocessor 136 is also connected through a power amplifier 150 and a d.c./a.c. inverter 152 to provide back lighting for display 44 upon request from an operator. An oscillator 154 and power circuitry 156 form a power supply for the back lighting of LCD screen 143. An audible alarm or beeper 158 receives a control signal from microprocessor 136 through an amplifier 160. Power is supplied from CPU 36 through a voltage regulator 162. A watchdog timer 164 monitors operation of microprocessor 136, and resets the microprocessor in the event of malfunction. Watchdog timer 164 monitors a pulse width modulated control output signal from microprocessor 136 that is applied to a circuit 166 for controlling contrast at screen 143.

Figure 8:
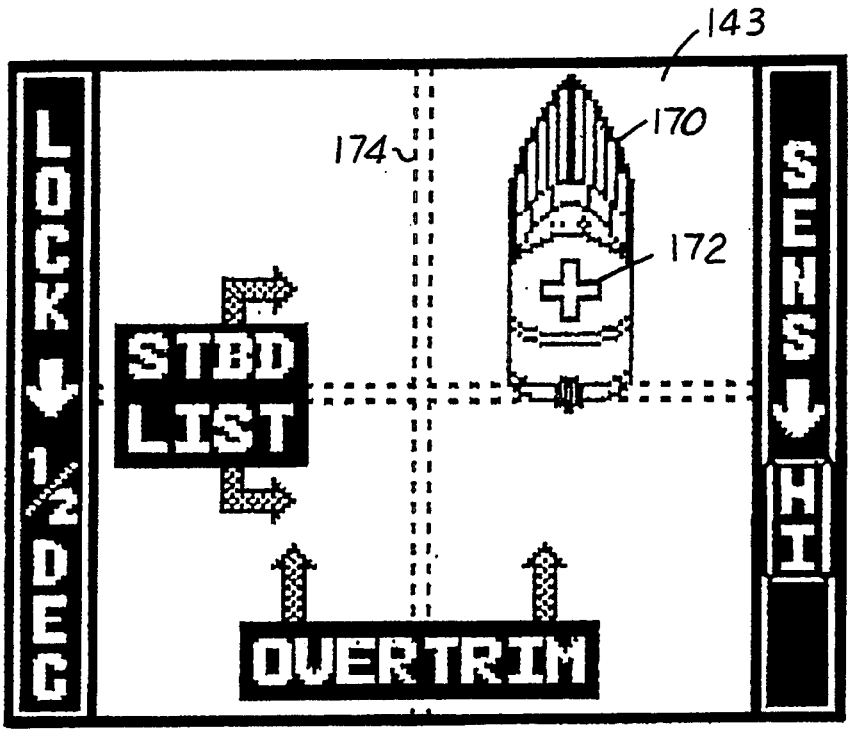
FIGS. 8 and 9 are diagrammatic illustrations of boat attitude display in two display modes of operation.
Figure 9:
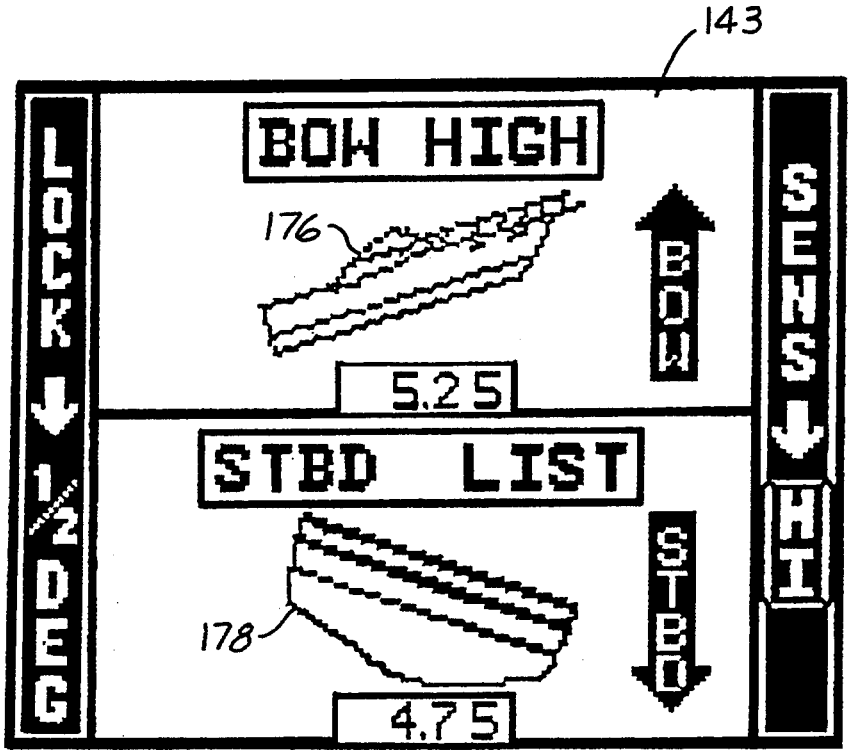

Operation of display console 38 in two differing display modes of operation, alternatively selectable by the operator, are illustrated in FIGS. 6 and 8, and in FIG. 9. In the first display mode of operation illustrated in FIGS. 6 and 8, an icon 170, in the form of a boat as schematically seen in plan view, is variable positionable on screen 143. Icon 170 includes a centrally positioned cross 172. Cross hairs 174 are displayed at screen 143. Upon depression of SET switch 147 (FIG. 6) by the operator, a corresponding command is sent by display microprocessor 136 to CPU microprocessor 98. CPU processor 98 then samples and stores the signals from sensor 32, indicative of current attitude of the boat. Typically, the operator depresses SET switch 147 when the boat is in the attitude that the operator desires to maintain. As the current boat attitude signals are stored in CPU microprocessor 98, boat icon 170 is positioned on screen 143 so that icon cross 172 is centered in cross hairs 174. Thereafter, as the boat departs from the desired attitude stored in CPU microprocessor 98, corresponding signals are transmitted by CPU microprocessor 98 to display microprocessor 136, and the latter controls position or orientation of icon 170 on screen 143 as a function of the magnitude and description of such departure from the desired attitude. The position of icon 170 on screen 143 thus indicates to an operator both magnitude and direction of such departure from desired boat attitude. For example, in the display shown in FIG. 6, icon 170 has moved to the lower right quadrant, indicating that the boat has assumed a starboard list, and that the bow is higher than desired. Indicia "STBD LIST" and "BOW HIGH" are simultaneously displayed to assist the operator in interpreting the icon display. In the illustration of FIG. 8, icon 170 has moved to the upper right quadrant with respect to cross hairs 74, indicating a starboard list and a bow low or "OVERTRIM" condition. Once again, suitable alphanumeric indicia also appear on display 143. If the boat were to assume a port list, icon 170 would be positioned to the left of the vertical cross hair 174, and corresponding alphanumeric indicia would appear on the right side of the screen. Cross hairs 174 are formed by interrupted lines, as shown in both FIGS. 6 and 8, with each interruption corresponding to one increment or unit of magnitude of departure from the desired attitude. In addition, the scales are illustrated in alphanumeric characters along the left edge of the screen.

In the second display mode of operation illustrated in FIG. 9, two boat icons 176,178 appear in the upper and lower halves of screen 143 respectively. Icon 176 is a schematic view of a boat in side elevation, and icon 178 is a schematic view of a boat in rear elevation. Once again, upon depression of SET switch 147 (FIG. 6), the current boat attitude is stored in CPU microprocessor 98, and icons 176,178 are oriented at zero angle. That is, icon 176 and icon 178 are horizontal. Thereafter, the icons change orientation in display 143 as actual boat attitude departs from the desired and stored boat attitude. Thus, the illustration of FIG. 9 in the second display mode of operation corresponds to the illustration of FIG. 6 in the first display mode of operation, indicating a bow high and starboard list attitude of the boat. Once again, alphanumeric indicia "BOW HIGH" and "STBD LIST" are displayed, together with the amount of actual undertrim and list—i.e., . "5.25" and "4.75" degrees respectively.

Figure 10A:
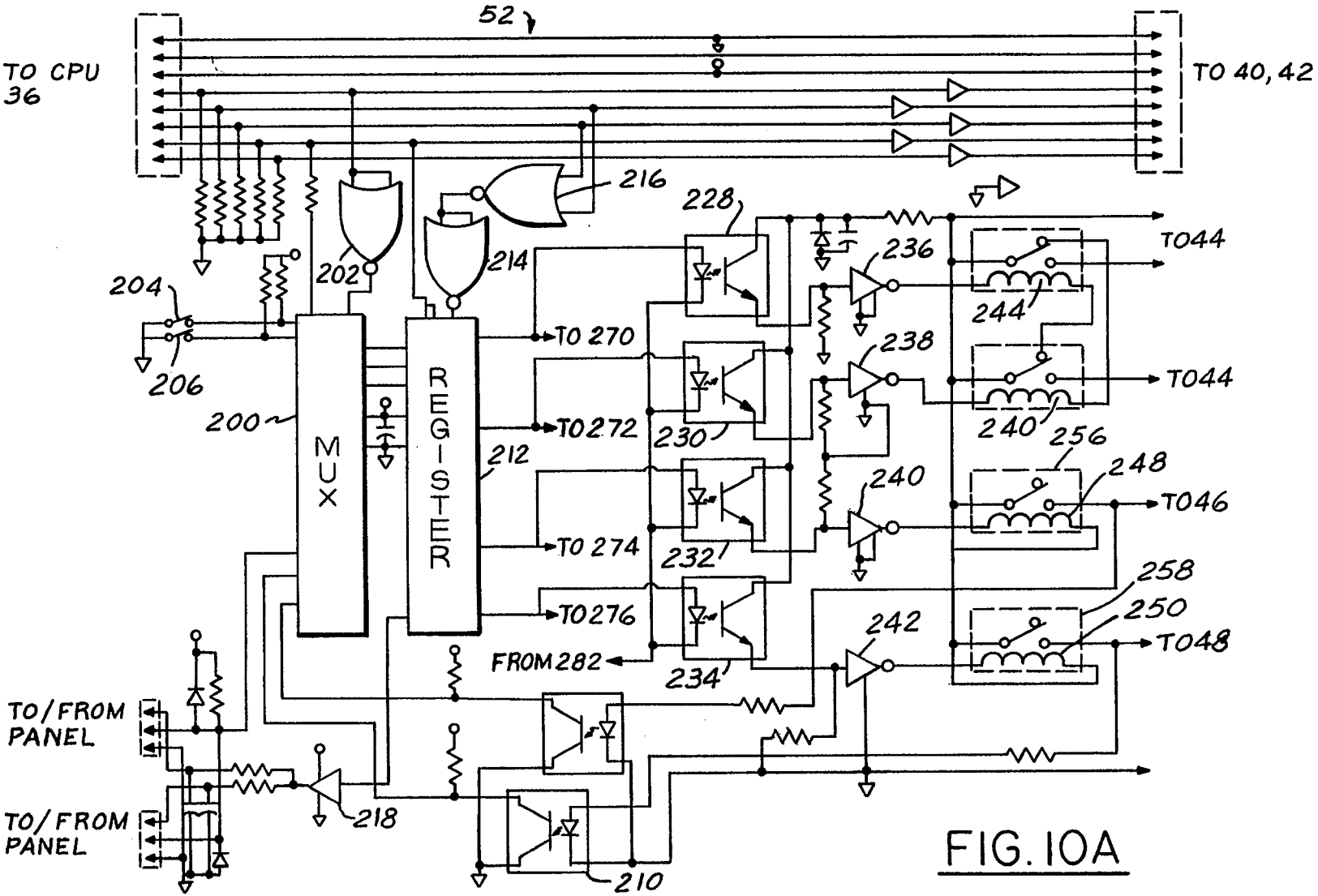
FIGS. 10A and 10B are an electrical schematic diagram of the automatic control circuit illustrated functionally in FIG. 2.
Figure 10B:
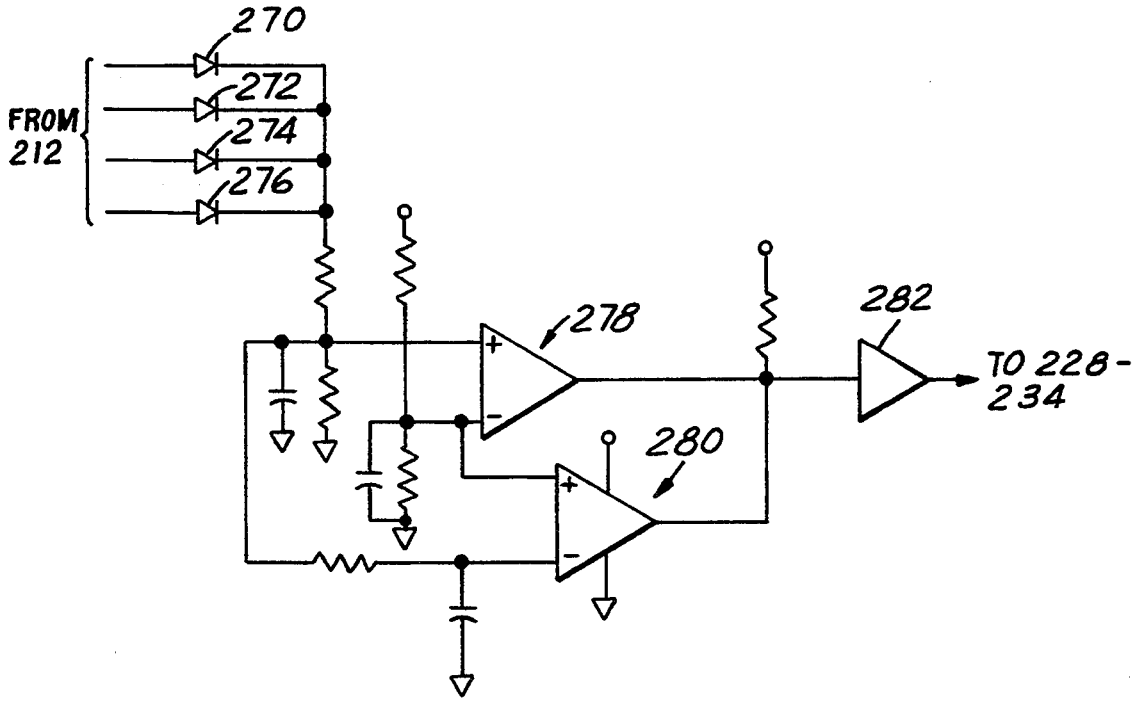

FIGS. 10A and 10B are an electrical schematic diagram of automatic control circuit 52. A multiplexer 200 receives serial input data from CPU 36, and a control input through a gate 202. Multiplexer 200 also receives inputs from switches 204,206. Switch 204 is factory preset if automatic control operation is desired, and switch 206 is factory preset for either single or dual actuators on each trim tab. Multiplexer 200 also receives inputs from a panel control switch (not shown) for selecting the automatic mode of operation, and from a pair of optical isolators 208,210, which indicate whether hydraulics 28 (FIG. 2) are being manually activated by switch 50 (FIG. 2). Manual activation by switch 50 overrides automatic control. A serial input register 212 receives input data from CPU 36, with the data being clocked into the register under control of CPU 36 and a pair of gates 214,216. The outputs of register 212 are connected to the control inputs of multiplexer 200, through an amplifier 218 to a panel indicator light, and to associated optical isolators 228–234. The outputs of register 212 are also connected through associated diodes 270–276 (FIG. 10B), which are "ORed" at the input of a delay 278. The output of delay 278 is connected through an amplifier 282 to enable operation of isolators 228–234. Diodes 270–276 are also connected to the input of a one-shot 280, which enables operation of amplifier 282 for a preselected time duration to prevent burnout of the pump motor.

The outputs of isolators 228–234 are connected through associated amplifiers 236–242 to the coils 244–250 of control relays 252–258. The normally open switch contacts of relays 252,254 are connected to the forward (tabs down) and reverse (tabs up) control inputs of pump 44 (FIG. 2). Likewise, the normally open contacts of relays 256,258 are connected to flow control valves 46,48. Upon command, the appropriate pump and/or valve relay is activated. Thus, any departure of boat attitude from the attitude desired by the operator is detected by CPU 36. Where automatic control is implemented, automatic control circuit 52 is energized by CPU 36 to control operation of pump 44 and valves 46,48. Boat attitude is thereby corrected.

Software for operation of CPU control microprocessor 98 and display control processor 136 as hereinabove described may be readily derived by persons of ordinary skill in the art based upon the foregoing discussion. Control programming in one presently preferred implementation of the invention is given in the Appendix that forms part of this disclosure. Such control programming in the Appendix is in machine code for 8031-type microprocessors. Programming for operation of CPU 36 in the manner described is at frames 3–7 of the Appendix, and programming for operation of display 38 as described is at frames 8–49 of the Appendix.

It will be appreciated that, although FIG. 2 illustrates a complete trim control system in accordance with the present invention, the various modules illustrated therein may be used in subcombinations without departing from the principles of the present invention in their broadest aspects. For example, sensor 32, CPU 36 and display 38 may advantageously be employed without automatic control 52 to indicate boat attitude by an operator, who can then make any desired corrections by means of manual switch 50. In the same way, sensor 32, CPU 36 and automatic control circuit 52 may be employed without display 38. Sensor 32, CPU 36 and display 38 may be employed on a sailboat, for example, where the operator may desire an attitude display even when he has no facility for trimming.

Sensor 32 is inexpensive and easy to install. The sensor is adapted to indicate changes in attitude about two axes independently of each other. Perhaps most importantly, any sensor adjustments are performed through microprocessor-based software control, rather than through mechanical adjustments at the sensor itself. Likewise, display 38 may be readily employed by boat operators with, little or no training, through manipulation of key switches 145,147,149,151,153. Display 38 indicates boat attitude about two axes, again independent of each other. The use of icons on the LCD display, in either of the display modes illustrated in FIGS. 8 and 9, readily advises the operator, in a form that is easy to understand, of actual boat attitude at any point in time, as well as the magnitude and direction of departure from desired attitude. Further, the display is updated substantially in real time. Desired attitude may be reset by mere manipulation of panel switches.

As previously noted, actuators 24,26 can be hydraulic, pneumatic or electric. One or more trim tabs 12,14 can be employed. There can be more than one actuator coupled to each trim tab. Sensor 32 preferably is mounted aft and central in the boat parallel to the keel.

We claim:

1. A boat trim control system that includes a boat having a hull, sensor means for mounting on said hull to provide electrical sensor signal as a function of actual boat attitude, and means coupled to said sensor means and responsive to said sensor signal for determining attitude of said boat hull, characterized in that said sensor means comprises:

a housing containing a dielectric fluid, and means for mounting said housing to said boat hull, a plurality of capacitance probe means positioned within said housing in a planar parallel array of diagonally spaced pairs, each of said capacitance probe means comprising a pair of spaced electrodes immersed in said fluid that such level of fluid between said electrodes and electrical capacitance between said electrodes vary as a function of attitude of said housing and said hull, and means coupled to said electrodes and responsive to variation in electrical capacitance between said electrodes for determining attitude of said housing as a function of relative capacitance among said plurality of capacitance probe means.

2. The system set forth in claim 1 wherein said variation-responsive means comprises electronic circuit means coupled to said plurality of capacitance probe means and providing an output signal having characteristics that vary as a function of capacitance at said plurality of capacitance probe means, and means for determining attitude of said housing as a function of said output signal.

3. The system set forth in claim 2 wherein said electronic circuit means comprises a plurality of said circuit means each connected to an associated one of said probe means and providing an associated said output signal, and wherein said attitude-determining means comprises means for determining said housing attitude as a function of comparison of said output signals.

4. The system set forth in claim 3 wherein said plurality of capacitance probe means comprises four capacitance probes positioned in an orthogonally spaced array within said housing, said attitude-determining means including means for determining housing attitude as a function of comparison of output signals associated with opposed pairs of said probes.

5. The system set forth in claim 4 wherein said attitude-determining means comprises means for determining hull attitude about fore/aft and port/starboard axes of said hull, independently of each other, as a function of said output signals.

6. The system set forth in claim 5 wherein said electronic circuit means comprises a printed circuitboard assembly mounted within said housing, said circuitboard assembly having contact means in electrical abutting engagement with said electrodes.

7. The system set forth in claim 6 wherein each of said capacitance probe means comprises a cylindrical inner electrode and a cylindrical outer electrode surrounding said inner electrode, said housing including means for holding said inner and outer electrodes spaced from each other while admitting said dielectric fluid therebetween.

8. The system set forth in claim 7 wherein said housing is of rectangular construction, said four capacitance probes being positioned adjacent to respective internal corners of said housing.

9. The system set forth in claim 4 wherein said electronic circuit means comprises four electronic oscillators, each said oscillator being coupled to an associated said probe such that output frequencies of said oscillators vary as a function of capacitance at the associated probe, and wherein said attitude-determining means comprises means for determining boat attitude as a function of differences among said frequencies.

10. The system set forth in claim 3 wherein said plurality of capacitance probe means comprises at least one pair of capacitance probes spaced from each other within said housing; and wherein said attitude-determining means comprises a pair of electronic oscillators respectively coupled to said probes such that output frequencies of said oscillators vary as a function of capacitance at the associated probe, and means for determining boat attitude about an axis orthogonal to separation between said probes as a function of a difference between said frequencies.

11. The system set forth in claim 1 further comprising means coupled to said attitude-determining means for displaying boat attitude to an operator.

12. The system set forth in claim 11 wherein said attitude-displaying means comprises a display screen, means for displaying an icon on said screen, and means coupled to said attitude-determining means for orienting said icon on said screen as a function of boat attitude.

13. The system set forth in claim 12 wherein said attitude-displaying means further comprises means responsive to an operator for setting said icon in a first orientation on said screen associated with a desired attitude of said boat, and means responsive to said attitude-determining means for varying orientation of said icon on said screen from said first orientation as a function of changes in boat attitude from said desired attitude.

14. The system set forth in claim 13 wherein said orientation-varying means comprises means coupled to said attitude-determining means and responsive to said setting means for storing signals indicative of boat attitude upon actuation of said setting means, and means responsive to said stored signals and to said attitude-determining means for varying orientation of said icon on said screen as a function of differences between said stored signals and output of said attitude-determining means.

15. The system set forth in claim 14 wherein said attitude-displaying means further comprises means for displaying on said screen alphanumeric indicia indicative of fore/aft and port/starboard orientation of said differences.

16. The system set forth in claim 14 wherein said attitude-displaying means comprises means for displaying cross hair indicia on said screen, means for displaying a boat icon on said screen, means responsive to said setting means for centering said boat icon in said cross hair indicia, and means responsive to said differences for moving said icon on said screen out of centered position in said cross hair indicia.

17. The system set forth in claim 16 wherein said icon-moving means includes means responsive to said differences for moving said boat icon out of said centered position by a distance that varies as a function of magnitude of departure from said desired attitude and in a direction that varies as a function of orientation of departure from said desired attitude.

18. The system set forth in claim 17 wherein said attitude-displaying means further includes means for displaying alphanumeric indicia associated with said cross hair indicia to indicate said magnitude and direction.

19. The system set forth in claim 14 wherein said attitude-displaying means comprises means for displaying first and second boat icons on said screen in side and end elevation respectively, means responsive to said differences for varying orientation of said first icon on said screen as a function of changes in fore/aft attitude of said boat, and means responsive to said differences for varying orientation of said second icon on said screen as a function of changes in port/starboard attitude of said boat.

20. The system set forth in claim 19 wherein said attitude-displaying means further includes means for displaying alphanumeric indicia associated with said first and second icons to indicate magnitude of said differences.

21. The system set forth in claim 15 wherein said setting means comprises a push button on said attitude-displaying means.

22. The system set forth in claim 21 wherein said orientation-varying means comprises a microprocessor-based screen controller.

23. The system set forth in claim 14 further comprising means movably mounted to said bull for timing attitude of said boat as said hull is propelled through the water, means for selectively adjusting said trimming means to maintain a desired attitude under varying conditions, said means for selectively adjusting said trimming means comprising means coupled to said attitude-displaying means for automatically adjusting position of said trimming means with respect to such hull as a function of said differences.

24. The system set forth in claim 23 wherein said attitude trimming means comprises at least one trim tab.

25. A boat trim control system that includes a boat having a hull, sensor means for mounting on said hull to provide an electrical sensor signal as a function of actual boat attitude, means coupled to said sensor means and responsive to said sensor signal for determining actual boat attitude, and means coupled to said attitude-determining means for displaying said actual boat attitude to an operator, said attitude-displaying means comprising a display screen, means for displaying an icon on said screen, means coupled to said attitude-determining means for movably orienting said icon on said screen as a function of actual boat attitude, means responsive to an operator for setting said icon in a first orientation on said screen associated with a desired attitude of said boat, and means responsive to said attitude-determining means for varying orientation of said icon on said screen from said first orientation as a function of changes in boat attitude from said desired attitude.

26. The system set forth in claim 25 wherein said orientation-varying means comprises means coupled to said attitude-determining means and responsive to said setting means for storing signals indicative of boat attitude upon actuation of said setting means, and means responsive to said stored signals and to said attitude-determining means for varying orientation of said icon on said screen as a function of differences between said stored signals and output of said attitude-determining means.

27. The system set forth in claim 26 wherein said attitude-displaying means further comprises means for displaying on said screen alphanumeric indicia indicative of fore/aft and port/starboard orientation of said differences.

28. The system set forth in claim 26 wherein said attitude-displaying means comprises means for displaying cross hair indicia on said screen, means for displaying a boat icon on said screen, means responsive to said setting means for centering said boat icon in said cross hair indicia, and means responsive to said differences for moving said icon on said screen out of centered position in said cross hair indicia.

29. The system set forth in claim 28 wherein said icon-moving means includes means responsive to said differences for moving said boat icon out of said centered position by a distance that varies as a function of magnitude of departure from said desired attitude and in a direction that varies as a function of orientation of departure from said desired attitude.

30. The system set forth in claim 29 wherein said attitude-displaying means further includes means for displaying alphanumeric indicia associated with said cross hair indicia to indicate said magnitude and direction.

31. The system set forth in claim 26 wherein said attitude-displaying means comprises means for displaying first and second boat icons on said screen in side and end elevation respectively, means responsive to said differences for varying orientation of said first icon on said screen as a function of changes in fore/aft attitude of said boat, and means responsive to said differences for varying orientation of said second icon on said screen as a function of changes in port/starboard attitude of said boat.

32. The system set forth in claim 31 wherein said attitude-displaying means further includes means for displaying alphanumeric indicia associated with said first and second icons to indicate magnitude of said differences.

33. The system set forth in claim 26 wherein said setting means comprises a push button on said attitude-displaying means.

34. The system set forth in claim 33 wherein said orientation-varying means comprises a microprocessor-based screen controller.

35. The system set forth in claim 26 further comprising means movably mounted on said hull for trimming attitude of said boat as said bull is propelled through the water, means for selectively adjusting said trimming means to maintain a desired attitude under varying conditions, said means for selectively adjusting said trimming means comprising means coupled to said attitude-displaying means for automatically adjusting position of said trimming means with respect to such hull as a function of said differences.

36. The system set forth in claim 25 wherein said sensor means comprises:

a housing containing a dielectric fluid and means for mounting said housing to said boat bull, a plurality of capacitance probe means positioned within said housing in spaced pairs, said pairs being oriented orthogonally of each other, each of said capacitance probe means comprising a pair of spaced electrodes immersed in said fluid such that level of fluid between said electrodes and electrical capacitance between said electrodes vary as a function of attitude of said housing and said bull, and means coupled to said electrodes and responsive to variations in electrical capacitance between said electrodes for determining attitude of said housing as a function of relative capacitance among said plurality of capacitance probe means.

37. The system set forth in claim 36 wherein said variation-responsive means comprises electronic circuit means coupled to said capacitance probe means and providing an output signal having characteristics that vary as a function of capacitance at said probe means, and means for determining attitude of said housing as a function of said output signal.

38. The system set forth in claim 37 wherein said electronic circuit means comprises a plurality of said circuit means each connected to an associated one of said probe means and providing an associated said output signal, and wherein said attitude-determining means comprises means for determining said housing attitude as a function of comparison of said output signals.

39. The system set forth in claim 38 wherein said plurality of capacitance probe means comprises four capacitance probes positioned in an orthogonally spaced array within said housing, said attitude-determining means including means for determining housing attitude as a function of comparison of output signals associated with opposed pairs of said probes.

40. The system set forth in claim 39 wherein said attitude-determining means comprises means for determining hull attitude about fore/aft and port/starboard axes of said hull, independently of each other, as a function of said output signals.

41. The system set forth in claim 40 wherein said electronic circuit means comprises a printed circuitboard assembly mounted within said housing, said circuitboard assembly having contact means in electrical abutting engagement with said electrodes.

42. The system set forth in claim 41 wherein each of said capacitance probe means comprises a cylindrical inner electrode and a cylindrical outer electrode surrounding said inner electrode, said housing including means for holding said inner and outer electrodes spaced from each other while admitting said dielectric fluid therebetween.

43. The system set forth in claim 42 wherein said housing is of rectangular construction, said four capacitance probes being positioned adjacent to respective internal corners of said housing.

44. The system set forth in claim 39 wherein said electronic circuit means comprises four electronic oscillators, each said oscillator being coupled to an associated said probe such that output frequencies of said oscillators vary as a function of capacitance at the associated probe, and wherein said attitude-determining means comprises means for determining boat attitude as a function of differences among said frequencies.

45. The system set forth in claim 38 wherein said plurality of capacitance probe means comprises at least one pair of capacitance probes spaced from each other within said housing; and wherein said attitude-determining means comprises a pair of electronic oscillators respectively coupled to said probes such that output frequencies of said oscillators vary as a function of capacitance at the associated probe, and means for determining boat attitude about an axis orthogonal to separation between said probes as a function of a difference between said frequencies.

46. A sensor for indicating orientation about orthogonal axes comprising:

a housing containing a dielectric fluid and means for mounting said housing to support structure, four capacitance probes positioned within said housing in a planar array of diagonally spaced parallel probes, each of said probes comprising a pair of spaced fixed electrode immersed in said fluid such that level of fluid between said electrodes and electrical capacitance between said electrodes vary as a function of attitude of said housing, and means coupled to said probes and responsive to variations in electrical capacitance between said electrode for determining attitude of said housing and said planar array as a function of relative capacitance among said probes.

47. The sensor set forth in claim 46 wherein said variations-responsive means comprises electronic circuit means coupled to said probes and providing an output signal having characteristics that vary as a function of capacitance at said probes, and means for determining attitude of said housing as a function of said output signal.

48. The sensor set forth in claim 47 wherein said electronic circuit means comprises a plurality of said circuit means each connected to an associated one of said probes and providing an associated said output signal, and wherein said attitude-determining means comprises means for determining attitude as a function of comparison of said output signals.

49. The sensor set forth in claim 48 wherein said attitude-determining means includes means for determining attitude as a function of comparison of output signals associated with opposed pairs of said probes.

50. The sensor set forth in claim 49 wherein said electronic circuit means comprises a printed circuitboard assembly mounted within said housing, said circuitboard assembly having contact means in electrical abutting engagement with said electrodes.

51. The sensor set forth in claim 50 wherein said electronic circuit means comprises four electronic oscillators, each said oscillator being coupled to an associated said probe such that output frequencies of said oscillators vary as a function of capacitance at the associated probe, and wherein said attitude-determining means comprises means for determining attitude as a function of differences among said frequencies.

52. The sensor set forth in claim 51 wherein each of said capacitance probes comprises a cylindrical inner electrode and a cylindrical outer electrode surrounding said inner electrode, said housing including means for holding said inner and outer electrodes spaced from each other while admitting said dielectric fluid therebetween.

53. The sensor set forth in claim 52 wherein said housing is of rectangular construction, said four capacitance probes being positioned adjacent to respective internal corners of said housing.

* * * * *

UNITED STATES PATENT AND TRADEMARK OFFICE

CERTIFICATE OF CORRECTION

PATENT NO. : 5,385,110

DATED : January 31, 1995

INVENTOR(S) : Bennett et al

It is certified that error appears in the above-identified patent and that said Letters Patent is hereby corrected as shown below:

On the title page item [57], line 2: Delete "bull" and replace with --hull--.

On the title page item [57], line 3: Delete "bull" and replace with --hull--.

On the title page item [57], line 11: Delete "bull" and replace with --hull--.

On the title page item [57], line 18: Delete "bull" and replace with --hull--.

Column 13, line 16: Delete "bull" and replace with --hull--.

Column 13, line 27: Delete "bull" and replace with --hull--.

Column 13, line 35: Delete "bull" and replace with --hull--.

Column 2, line 9: Delete "bull" and replace with --hull--.

Column 2, line 36: Delete "bull" and replace with --hull--.

UNITED STATES PATENT AND TRADEMARK OFFICE

CERTIFICATE OF CORRECTION

PATENT NO. : 5,385,110

DATED : January 31, 1995

INVENTOR(S) : Bennett, et al

It is certified that error appears in the above-indentified patent and that said Letters Patent is hereby corrected as shown below:

Column 11, line 64: Delete "bull" and replace with --hull--.

Signed and Sealed this

Twenty-fifth Day of April, 1995

*Attest:*

Bruce Lehman

BRUCE LEHMAN

*Attesting Officer*

*Commissioner of Patents and Trademarks*